US005815185A

United States Patent [19]

Pietrzyk

[11] Patent Number: 5,815,185

[45] Date of Patent: Sep. 29, 1998

[54] INK FLOW HEAT EXCHANGER FOR INKJET PRINTHEAD

[75] Inventor: Joe R. Pietrzyk, San Diego, Calif.

[73] Assignee: Hewlett-Packard Company, Palo Alto, Calif.

[21] Appl. No.: 748,726

[22] Filed: Nov. 13, 1996

[51] Int. Cl.[6] ..... B41J 2/19

[52] U.S. Cl. ..... 347/92; 347/85

[58] Field of Search ..... 347/84, 85, 86, 347/92, 17, 18, 63, 65

[56] References Cited

U.S. PATENT DOCUMENTS 5,459,498 10/1995 Seccombe et al. ..... 347/18

*Primary Examiner*—Benjamin R. Fuller
*Assistant Examiner*—Juanita Stephens

[57] ABSTRACT

An ink conduit for an inkjet printhead is disclosed which increases the velocity of ink flowing across the back surface of a substrate and into ink ejection chambers. The increased velocity of ink across the back surface of the substrate results in greater removal of heat from the substrate. This increased ink velocity is achieved by providing narrow ink conduit openings proximate to the back surface of the substrate. To avoid air bubbles becoming trapped in the relatively narrow ink conduit, one or more pockets are formed to allow the accumulation of bubbles, so that the bubbles do not affect the ink flow through the ink conduit and into the ink ejection chambers.

20 Claims, 6 Drawing Sheets

FIG. 5
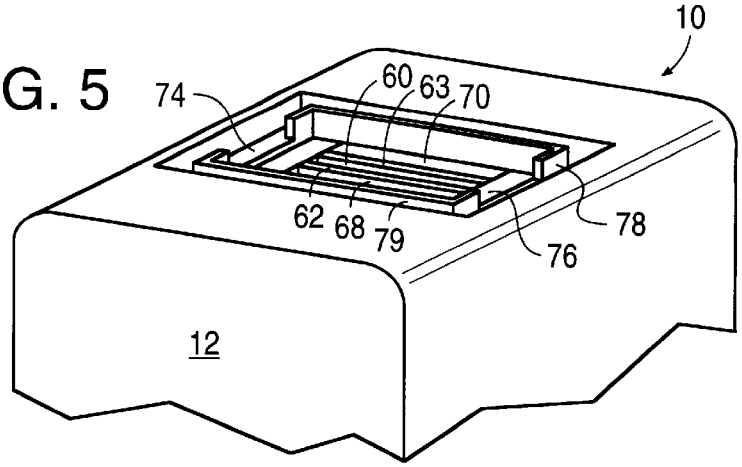
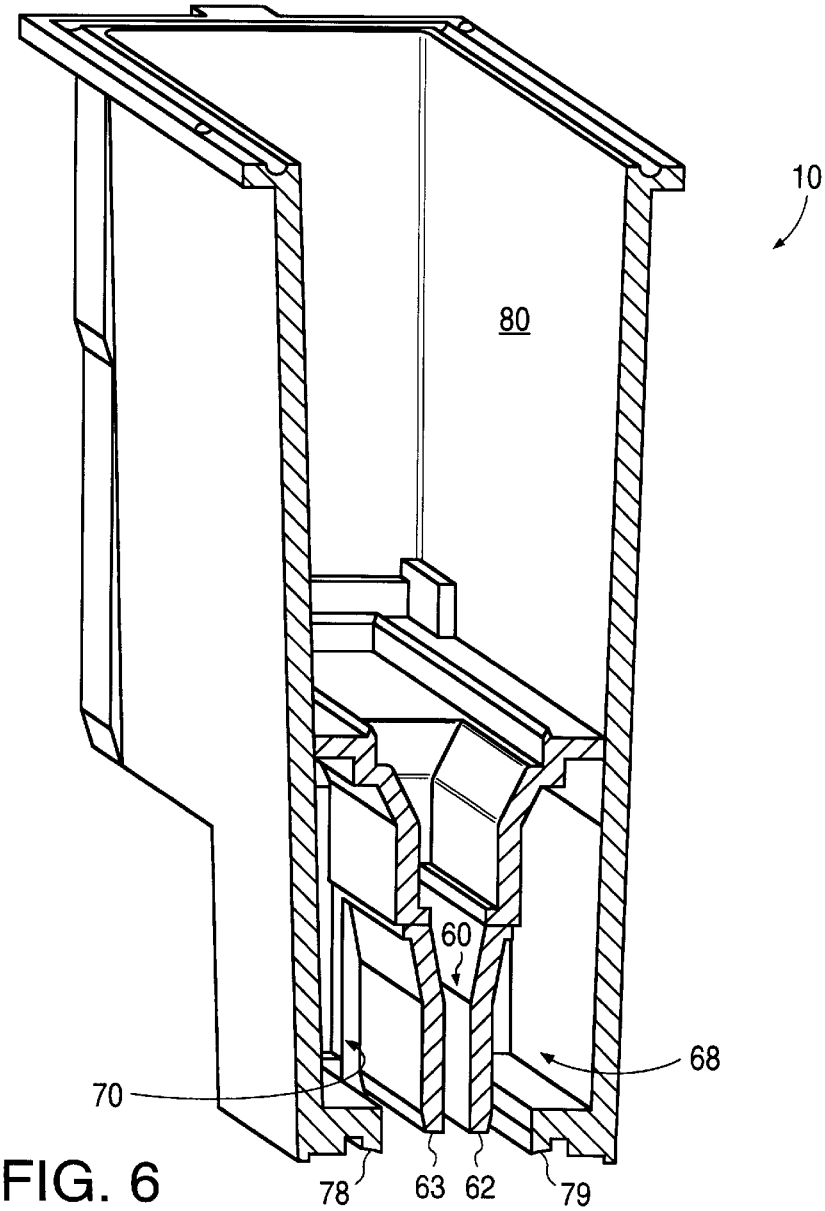
FIG. 6

INK FLOW HEAT EXCHANGER FOR INKJET PRINTHEAD

FIELD OF THE INVENTION

This invention relates to inkjet printers and, more particularly, to the printhead portion of the printer.

BACKGROUND OF THE INVENTION

FIG. 1 illustrates a print cartridge 10 for use in an inkjet printer. The present invention relates to a structure internal to a print cartridge, and the print cartridge 10 of FIG. 1 will be used to describe a prior art printhead structure and the printhead structure of the present invention.

The inkjet print cartridge 10 includes an ink reservoir 12 and a printhead 14, where printhead 14 is formed using Tape Automated Bonding (TAB). Printhead 14 includes a nozzle member 16 comprising two parallel columns of offset nozzles 17 formed in a flexible polymer tape 18 by, for example, laser ablation.

The back surface of tape 18, shown in FIG. 2, includes conductive traces 19 formed thereon using a conventional photolithographic etching and/or plating process. These conductive traces are terminated by large contact pads 20 (FIG. 1) designed to interconnect with a printer. The print cartridge 10 is designed to be installed in a scanning carriage so that the contact pads 20 contact printer electrodes in the carriage providing energization signals to the printhead.

Windows 22 and 24 are used when bonding the ends of the conductive traces 19 to electrodes on a substrate 28 affixed to the underside of tape 18. The electrodes are connected to ink ejection elements, each ink ejection element being associated with a single nozzle 17. The ink ejection elements may be heater resistors. Additional detail of the construction of tape 18 and substrate 28 is described in U.S. Pat. No. 5,278,584 to Brian Keefe, et al., assigned to the present assignee and incorporated herein by reference.

FIG. 2 also shows a barrier layer 30 which is etched to form an ink ejection chamber for each ink ejection element. Ink channels 32 are shown through which ink flows into an associated ink ejection chamber.

FIG. 3 is a cross-sectional view of the print cartridge 10 along line 3—3 illustrating the flow of ink 38 into two ink ejection chambers 40. The back surface of tape 18 is sealed with respect to a headland 41 of the print cartridge body 42 by an adhesive 43. Ink 38 flows from the ink reservoir 12, contacts the back surface of substrate 28, and flows around the outer edges of substrate 28 into the various ink ejection chambers 40. When an ink ejection element 46 is energized, a droplet of ink 48 is ejected from an associated nozzle 17 onto the media.

One advantage of this particular ink delivery design is that the ink flowing along the back surface of substrate 28 withdraws heat from substrate 28. When the ink 38 is warmed, the solubility of air in the ink decreases. When this happens, air diffuses out of the ink 38 and forms bubbles 52. The bubbles 52 grow and float up and away from substrate 28. The ink conduit 54 was designed to be deep in order to give the bubbles 52 a place to go; otherwise, the bubbles 52 would fill up the ink conduit 54 and cause printhead starvation within a few hundred pages of printing.

One problem which has been discovered with this design is that a thermal limitation occurs. The temperature of substrate 28, in some applications, gets high enough to degrade the print quality, and the flow of ink across the back surface of substrate 28 is insufficient to adequately cool substrate 28. One reason for the reduction in print quality is that the printhead is finely tuned to operate optimally within a narrow temperature range (approximately 45° C. to 75° C.). Since the ink properties (e.g., viscosity) and the characteristics of drive bubble nucleation and growth are strongly dependent on the temperature, the printhead does not perform optimally outside of this temperature range. The printhead can easily be heated automatically during operation to insure the substrate temperature is always greater than the lower bound. However, maintaining the substrate temperature below the upper bound is difficult. At high temperatures, additional problems, other than variations in the ink and nucleation stated above, such as reboiling, can occur.

Accordingly, it is desirable to modify the design of the structure of FIG. 3 to provide better cooling of substrate 28 while avoiding any bubble accumulation which could starve the printhead.

SUMMARY

An ink conduit for an inkjet printhead is disclosed which increases the velocity of ink flowing across the back surface of a substrate. The ink ultimately flows into ink ejection chambers. The increased velocity of ink across the back surface of the substrate results in greater removal of heat from the substrate. This increased ink velocity is achieved by providing narrow ink conduit openings proximate to the back surface of the substrate through which the ink must flow.

An additional benefit that occurs as a result of this new design is a decrease in air outgassing from the ink as compared to the prior design of FIG. 3. This is because the substrate temperature, and therefore the surrounding ink temperatures, are reduced due to the enhanced convective heat transfer that occurs on the back surface of the substrate. The solubility of air in the ink is greater at lower temperature, consequently fewer bubbles form and get trapped in the pen.

To avoid air bubbles becoming trapped in the relatively narrow ink conduit, pockets on both sides of the ink conduit are formed to allow the accumulation of bubbles so that bubbles do not affect the ink flow around the sides of the substrate and into the ink ejection chambers.

In an alternative embodiment, for use with a substrate having a center slot through which ink flows, an ink conduit for supplying ink through the center slot in the substrate is made relatively narrow for increased ink velocity, and a central pocket for bubbles is created.

BRIEF DESCRIPTION OF THE DRAWINGS

FIG. 5 is a perspective view the preferred print cartridge of FIG. 1 with tape 18 removed showing the ink conduit leading to the back surface of the substrate.

FIG. 6 is a cross-sectional, perspective view of the print cartridge of FIG. 1 along line 3—3 illustrating an ink chamber for containing a pressure regulator and the ink conduit leading to the back surface of the substrate.

DETAILED DESCRIPTION OF THE PREFERRED EMBODIMENTS

Figure 1:
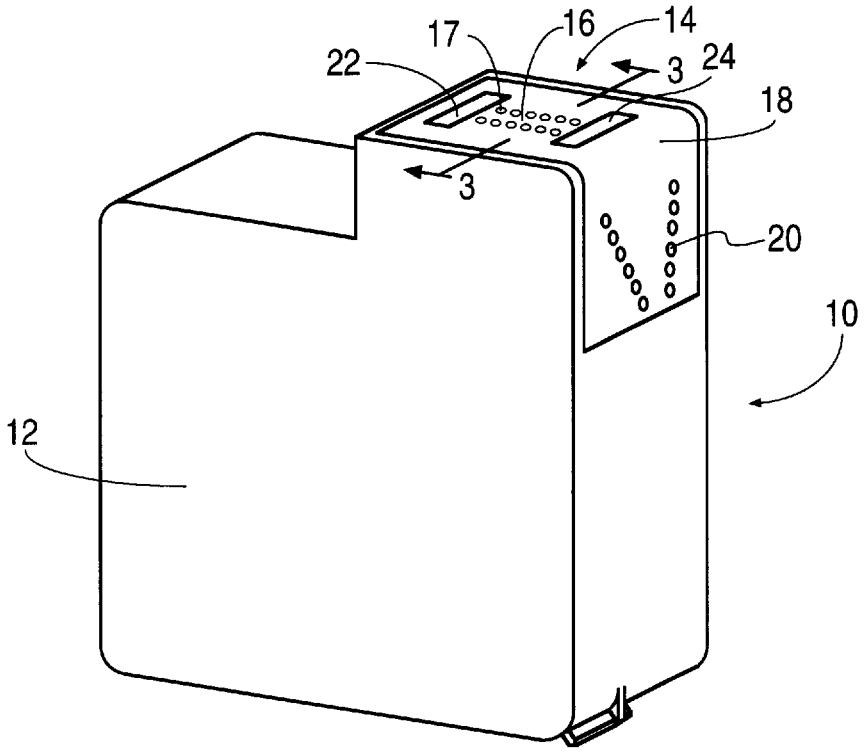
FIG. 1 is perspective view of a print cartridge which may incorporate the present invention.
Figure 3:
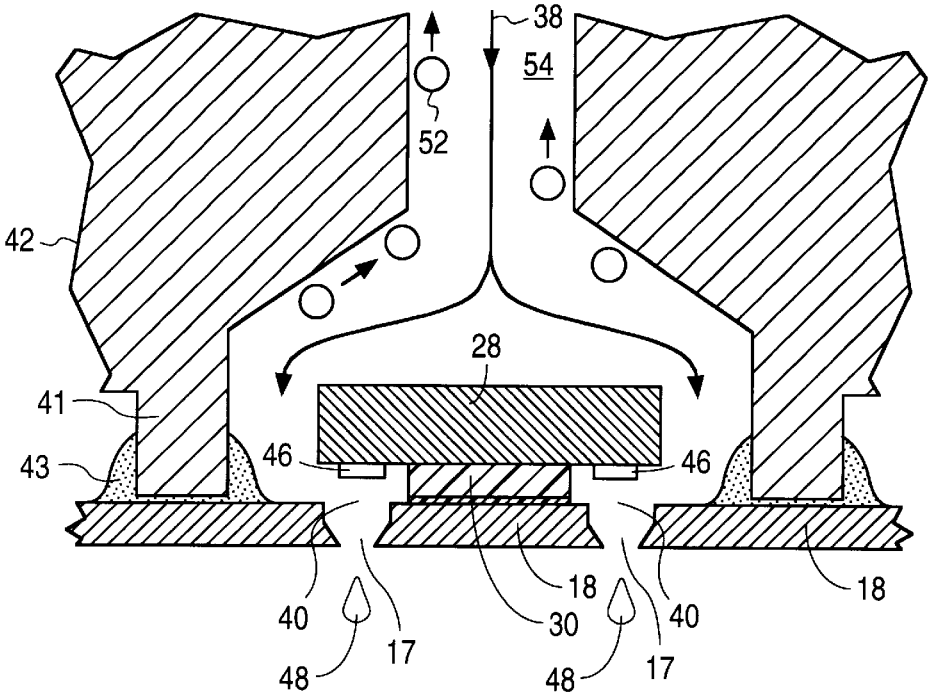
FIG. 3 (PRIOR ART)
FIG. 3 is a cross-sectional view along line 3—3 in FIG. 1 illustrating Hewlett-Packard's previous design of the printhead.
Figure 4:
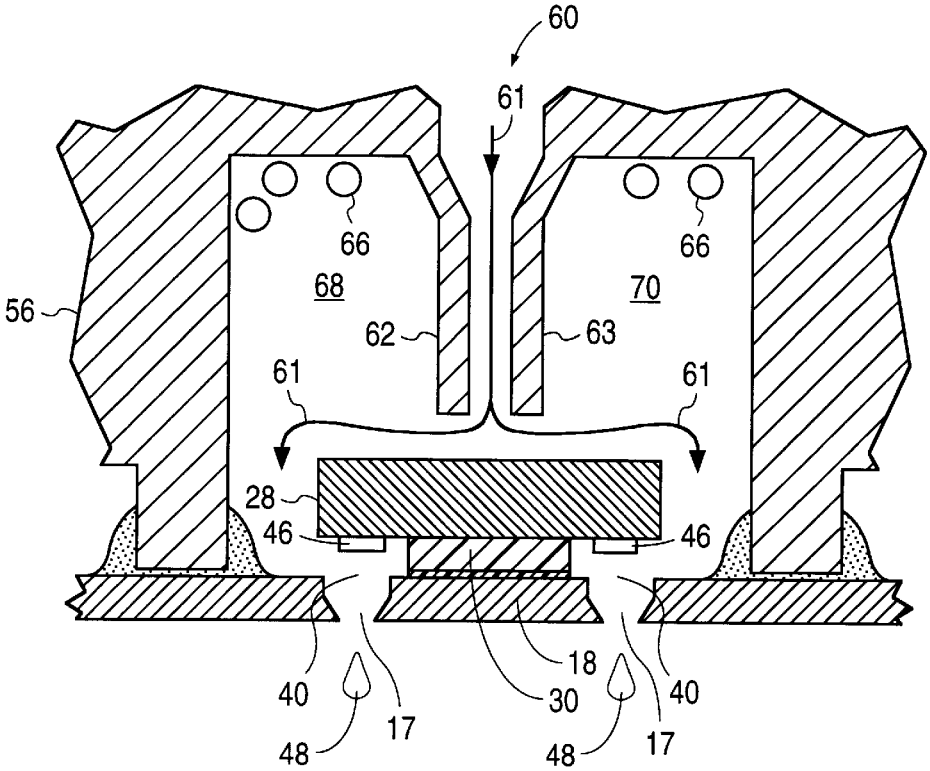
FIG. 4 is a cross-sectional view along line 3—3 of FIG. 1 illustrating the preferred modification to the prior art ink conduit of FIG. 3.

FIG. 4 is a cross-sectional view along line 3—3 of FIG. 1, illustrating the preferred embodiment of the invention. Elements identified with the same numerals as in other figures may be identical and will not be redundantly described. In FIG. 4, the plastic print cartridge body 56 is formed such that the ink conduit 60 directs the flow of ink from an ink chamber within the print cartridge 10 towards the back of the substrate 28 and through a narrow gap that exists between the back of the substrate 28 and the walls 62 and 63. The gap at the end of ink conduit 60 is much narrower than the gap between the ink conduit 54 and substrate 28 shown in FIG. 3. The walls 62 and 63 of the ink conduit 60 terminate approximately 0.127 mm (5 mils) from the back of the substrate 28, thereby forming the narrow gap. An acceptable range for this gap is from about 3 mils to about 12 mils, depending on the ink viscosity and flow rates. The distance, in the preferred embodiment, between walls 62 and 63 is approximately 1 mm. The distance between walls 62 and 63 may be anywhere between about 1 mm and 5 mm. Other distances may also be suitable depending upon the size of substrate 28, ink viscosity, and flow rates. The thickness of walls 62 and 63 is about 0.5 mm, but thinner walls will also work. The lower limit is dependent more on manufacturing tolerances than on thermal performance of the device. Walls thicker than 0.5 mm will also work. Thicker walls will have better thermal performance, but also worse pressure drop and bubble tolerance.

Although the same volume of ink is ejected from nozzles 17 in both FIG. 3 and FIG. 4, the ink velocity across the back of substrate 28 in FIG. 4 is much higher than across the back of the substrate 28 in FIG. 3 due to the narrower gap that exits at the end of ink conduit 60 relative to the large area available for flow everywhere in ink conduit 54. The increased ink velocity caused by the proximity of the ends of walls 62 and 63 to the back of substrate 28 cause a relatively large transfer of heat from the back of substrate 28 to the moving ink. The heated ink flows around the edges of substrate 28 and into the ink ejection chambers 40.

As the ink heats up, the solubility of air in the ink decreases, and air defuses out of the ink in the form of bubbles 66. In order for these bubbles 66 to not restrict the flow of ink, bubble accumulation chambers 68 and 70 are formed in the print cartridge body to accumulate these bubbles. Hence, bubbles 66 will not interfere with the flow of ink through ink conduit 60 and around the edges of substrate 28 to the ink ejection chambers 40. In the preferred embodiment, these chambers 68 and 70 each have a capacity of 2 to 3 cubic centimeters; however, the capacity can be greater than or less than this preferred volume depending on the anticipated outgassing. An acceptable range is approximately 1 to 5 cubic centimeters. Chambers 68 and 70 extend along the length of substrate 28 to be in fluid communication with all the ink channels 32 (FIG. 2) on substrate 28.

FIG. 5 is perspective view of the preferred embodiment print cartridge 10 in FIG. 1 with the tape 18 removed along with substrate 28 to reveal walls 62 and 63, ink conduit 60, and chambers 68 and 70. In one embodiment, the preferred length of substrate 28 is approximately one-half inch so that the lengths of walls 62 and 63 are slightly less than one-half inch.

Figure 2:
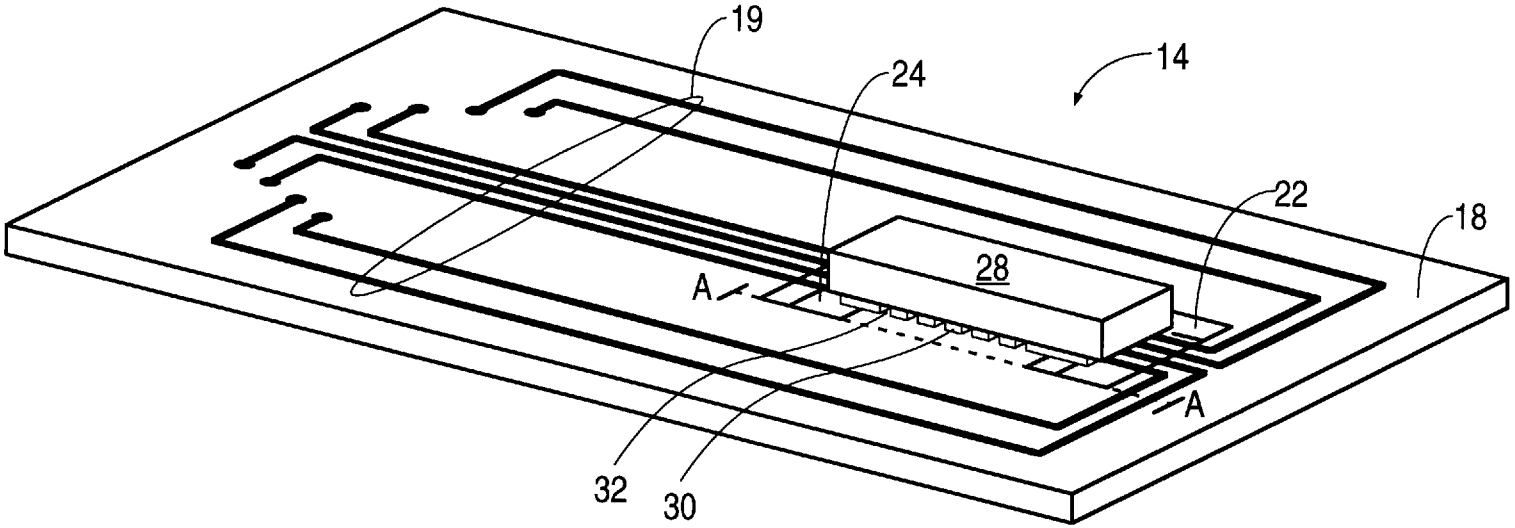
FIG. 2 (PRIOR ART)
FIG. 2 is one embodiment of a prior art printhead portion of the print cartridge of FIG. 1 removed from the print cartridge.

An adhesive/sealant is applied to headland areas 74 and 76, and the assembly of FIG. 2 is then secured to the print cartridge 10 as shown in FIG. 1. The adhesive/sealant at areas 74 and 76 squishes upward to secure the ends of the substrate 28 to the print cartridge body and insulate the conductive traces on the back of tape 18 so that they will not be shorted by any ink in the vicinity of the conductors. An adhesive/sealant along the top of headland walls 78 and 79 secures the tape 18 to the print cartridge body.

FIG. 6 is a cross-sectional, perspective view of the print cartridge 10 body of FIG. 1 along line 3—3, with tape 18 removed, showing an ink chamber 80, ink conduit 60, walls 62 and 63, and bubble accumulation chambers 68 and 70.

In the preferred embodiment, print cartridge 10 has an ink valve into which ink flows from an external ink source. The ink valve internal to print cartridge 10 is automatically opened and closed by an internal ink pressure regulator which senses the pressure difference between the ambient pressure and the pressure internal to the ink chamber 80, so as to maintain a relatively constant negative pressure within ink chamber 80. This negative pressure prevents ink drooling from nozzles 17. A detailed description of this internal pressure regulator and ink refill feature is found in U.S. application Ser. No. 08/550,902, entitled Printer Using Print Cartridge with Internal Pressure Regulator, by Norman Pawlowski, Jr., filed Aug. 30, 1996, incorporated herein by reference.

Figure 7:
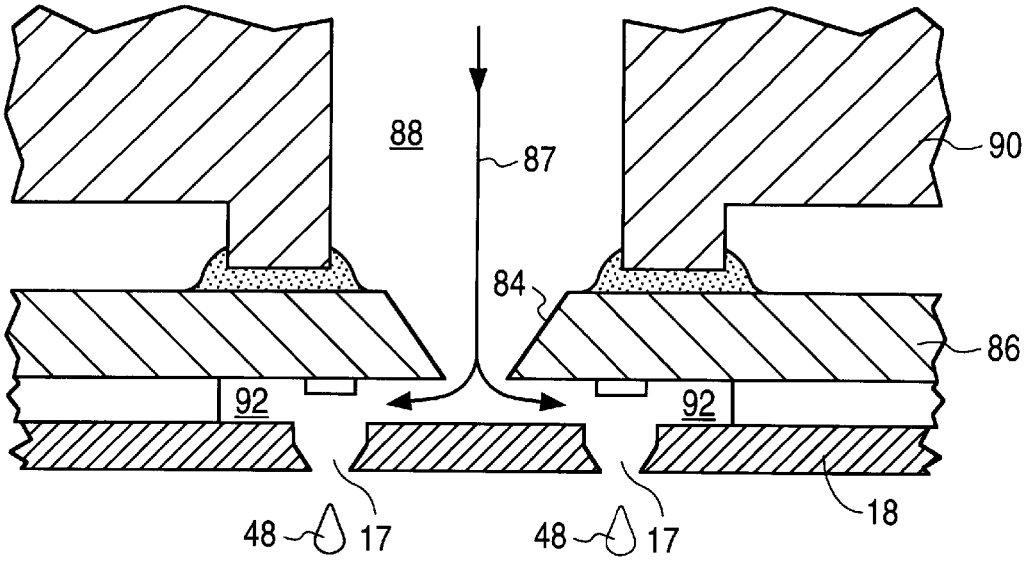
FIG. 7 (PRIOR ART)
FIG. 7 illustrates a prior art center-feed printhead design.
Figure 8:
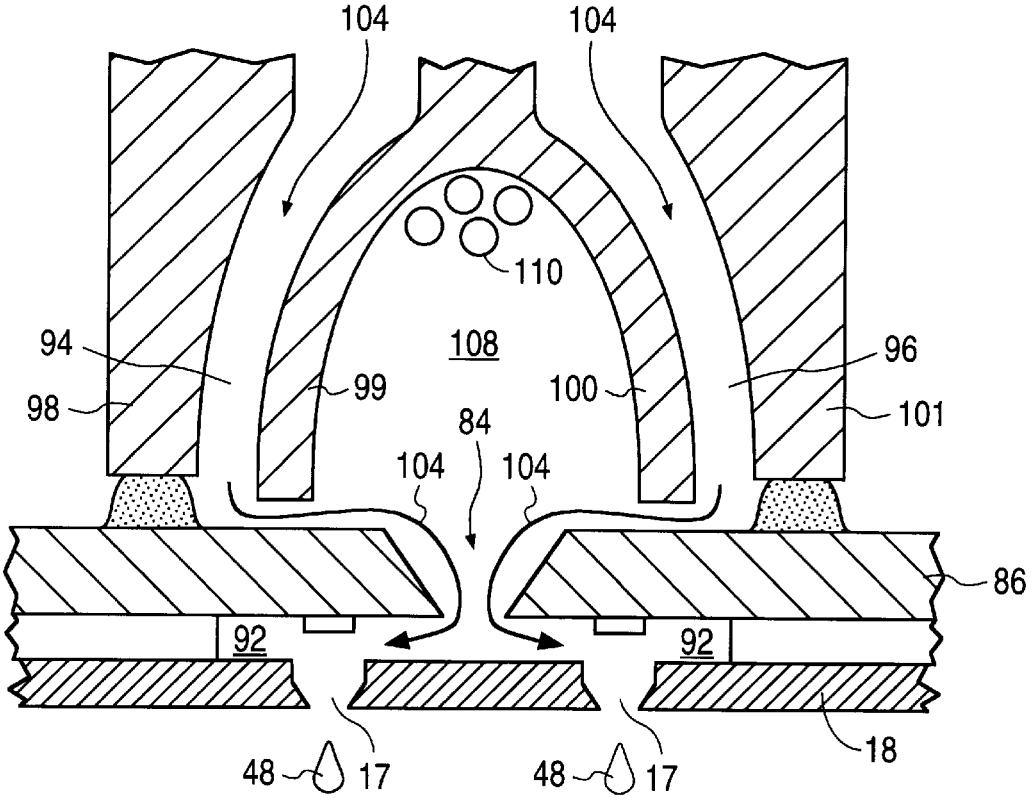
FIG. 8 illustrates a modification to the center-feed printhead design of FIG. 7 which utilizes the present invention to increase the ink velocity over the back surface of the substrate for increased cooling of the substrate and to accumulate bubbles.

The inventive concepts described above for increasing the velocity of ink flowing across a substrate while avoiding the possibility of bubbles blocking the ink conduit may be applied to other types of printheads as shown with respect to FIGS. 7 and 8.

FIG. 7 is a cross-sectional along line 3—3 of FIG. 1 if print cartridge 10 of FIG. 1 incorporated a center-feed ink slot 84 in substrate 86. Ink 87 flows through ink conduit 88, formed in print cartridge body 90, and through ink slot 84. Ink 87 then flows outward into ink ejection chambers 92.

Using the present invention, this prior art center-feed design of FIG. 7 is modified as shown in FIG. 8, wherein ink conduits 94 and 96 are formed by walls 98, 99, 100 and 101. The narrow gaps formed between the back of the substrate 86 and walls 99 and 100 cause the ink 104 at relatively high velocity to run along a larger surface area of substrate 86 to remove heat from substrate 86 before proceeding through the center ink slot 84 of substrate 86. A central bubble accumulation chamber 108 is shown which accumulates bubbles 110 which have out-diffused from the ink 104 as the ink 104 is heated by substrate 86. The complete structure of the printhead illustrated in FIG. 8 would be readily understood by one skilled in the art after reading this disclosure.

Thus, various embodiments of an improved print cartridge have been described. Such a print cartridge may be a single-use disposable cartridge, a refillable cartridge, or a cartridge connected to an external ink supply.

The volume of the bubble accumulation chambers described herein should be sufficient to store bubbles accumulated over the expected life of the print cartridge. Since the solubility curve for air in ink may differ for different types of ink, the required minimum volume of the bubble accumulation chambers will be dependent on the type of ink used.

The added heat withdrawn from the substrate due to the novel ink conduit allows the printhead to operate at higher speeds without adversely affecting the print quality. The enhanced thermal performance does not rely on any attachments to the substrate, such as a heat exchanger. Such attachments would likely be much more complex and costly.

Figure 9:
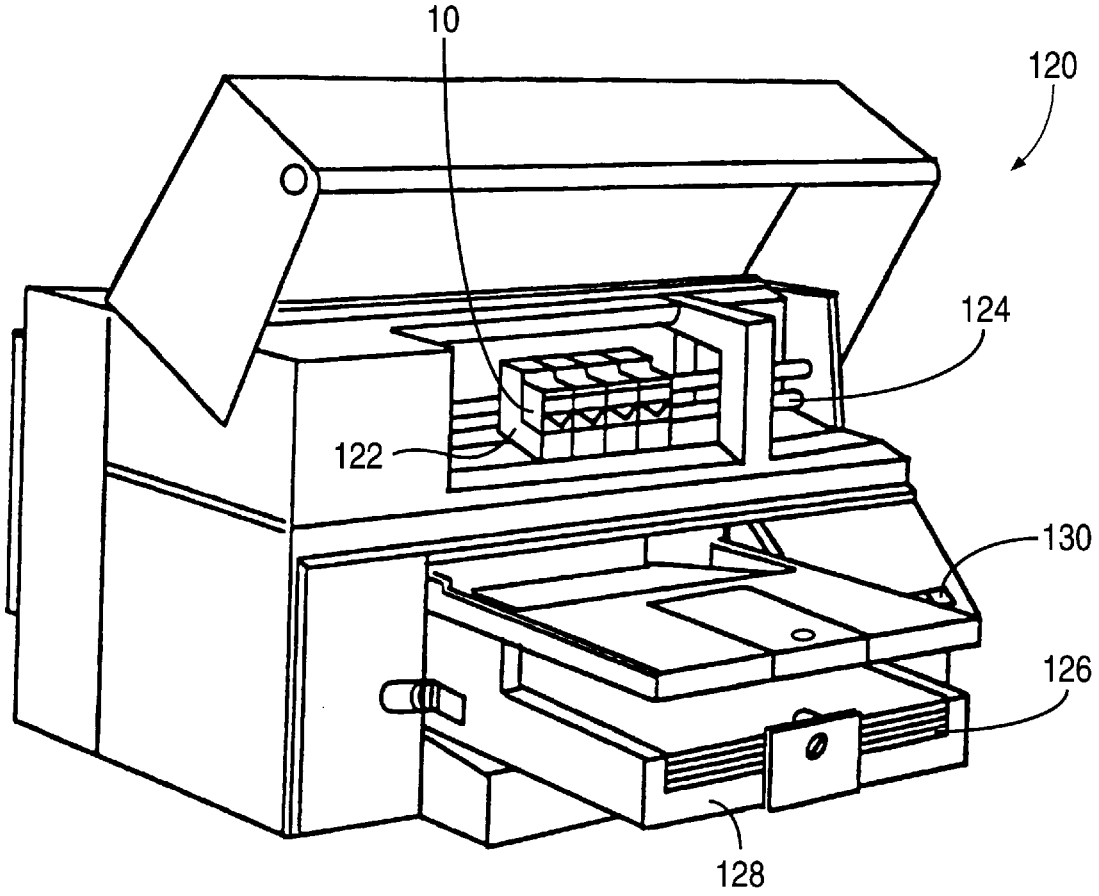
FIG. 9 is a perspective view of an inkjet printer incorporating the print cartridge of the present invention.

FIG. 9 is a perspective view of an inkjet printer 120 incorporating the print cartridge 10 of the present invention. In the particular embodiment shown in FIG. 9, a scanning carriage 122 contains four print cartridges 10, one print cartridge for each of the colors black, cyan, magenta, and yellow. The scanning carriage 100 moves back and forth across a print zone, along rod 124, while printing ink dots on a medium. After a single scan or multiple scans, the medium is then advanced in a direction perpendicular to the scanning direction of carriage 122 and printing is again resumed. Paper 126 is fed from an input paper tray 128, into the print zone, and forwarded to an output tray 130 after printing. The mechanism for scanning carriage 122 and for transporting paper 126 may be conventional.

The foregoing has described the principles, preferred embodiments, and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printing device comprising:

a substrate having a front surface for facing a medium to be printed upon, said substrate having a back surface;

a plurality of ink election chambers on said front surface which define cavities for receiving ink;

a plurality of ink election elements, each ink election element being within a respective ink election chamber, said ink election elements being heated by electrical signals to elect droplets of said ink from a respective nozzle in fluid communication with a respective ink ejection chamber;

an ink conduit having a first wall and a second wall terminating proximate to said back surface of said substrate, so that ink flows through said ink conduit, across at least a portion of said back surface of said substrate, and into said ink ejection chambers; and at least one bubble accumulation chamber for accumulating bubbles caused by heating of said ink by said substrate due to said electrical signals heating said ink election elements, said at least one bubble accumulation chamber comprising a cavity substantially surrounding said back surface of said substrate, said cavity configured such that said bubbles do not interfere with the flow of ink across said back surface of said substrate and into said ink election chambers.

2. The device of claim 1 wherein said substrate has outer edges, wherein said ink conduit is a single ink channel having an opening along a middle of said back surface of said substrate, and wherein ink flows from said opening, across said back surface of said substrate, along one or more of said outer edges of said substrate, and into said ink ejection chambers.

3. The device of claim 1 wherein said bubble accumulation chamber is located such that bubbles formed by heating of said ink when flowing over said back surface of said substrate rise and are accumulated in said bubble accumulation chamber.

4. The device of claim 1 wherein said first wall and said second wall have lengths at least as long as a length of an array of said ink ejection chambers on said front surface of said substrate.

5. The device of claim 1 wherein each of said first wall and said second wall has an end, and wherein a gap between said back surface of said substrate and ends of said first wall and said second wall is less than about 12 mils.

6. The device of claim 5 wherein said gap is about 3 to 7 mils.

7. The device of claim 1 wherein a distance between said first wall and said second wall proximate to said back surface of said substrate is less than about 5 millimeters.

8. The device of claim 7 wherein said distance between said first wall and said second wall proximate to said back surface of said substrate is approximately 1 millimeter to 3 millimeters.

9. The device of claim 1 wherein a total volume of said at least one bubble accumulation chamber is greater than about 1 cubic centimeter.

10. The device of claim 9 wherein said total volume of said at least one bubble accumulation chamber is between approximately 2 to 3 cubic centimeters.

11. The device of claim 1 wherein said first wall has a side and said second wall has a side, wherein said at least one bubble accumulation chamber comprises a first bubble accumulation chamber on said side of said first wall and a second bubble accumulation chamber on said side of said second wall.

12. The device of claim 1 wherein said substrate has outer edges, said device further comprising:

an ink channel which allows said ink flowing across at least a portion of said back surface of said substrate to flow around one or more of said outer edges of said substrate and into said ink ejection chambers.

13. The device of claim 1 further comprising:

a slot formed in said substrate; and an ink channel which allows said ink flowing across at least a portion of said back surface of said substrate to flow through said slot formed in said substrate and into said ink ejection chambers.

14. The device of claim 1 wherein said substrate, said ink conduit, and said at least one bubble accumulation chamber is formed in a print cartridge for insertion into a scanning carriage in an inkjet printer, said print cartridge further comprising an ink chamber leading to said ink conduit.

15. The device of claim 14 wherein said ink chamber receives ink from an external ink supply.

16. The device of claim 14 further comprising a scanning carriage supporting said print cartridge.

17. The device of claim 16 further comprising:

an inkjet printer providing energization signals to said ink ejection elements, for ejecting ink from said ink ejection chambers, while causing said carriage to scan across a medium to be printed upon.

18. A method performed by a printer, said printer comprising a carriage and a printhead mounted in said carriage, said printhead comprising a substrate having a back surface and having a front surface for facing a medium to be printed upon, said ink ejection elements being located within respective ink ejection chambers on said front surface of said substrate, each of said ink ejection chambers defining a cavity for receiving ink, said printhead containing one or more bubble accumulation chambers, said one or more bubble accumulation chambers comprising a cavity substantially surrounding said back surface of said substrate, said cavity configured such that accumulated bubbles do not interfere with the flow of ink across said back surface of said substrate and into said ink ejection chambers, said method comprising the steps of:

scanning said carriage across a print zone;

providing energizing signals to heat said ink ejection elements within respective ink ejection chambers in said printhead mounted in said carriage;

supplying ink through an ink conduit having an opening proximate to said back surface of said substrate, said ink flowing through said opening, across at least a portion of said back surface of said substrate, and into said ink ejection chambers;

generating bubbles from gas being released from said ink as said ink is heated by energizing said ink ejection elements; and accumulating said bubbles in said one or more bubble accumulation chambers.

19. The method of claim 18 wherein said substrate has outer edges, said method further comprising the steps of:

flowing said ink around one or more of said outer edges of said substrate and into said ink ejection chambers after said ink flows across at least a portion of said back portion of said substrate.

20. The method of claim 18 wherein said substrate includes a slot, said method further comprising the steps of:

flowing said ink through a slot formed in said substrate and into said ink ejection chambers after said ink flows across at least a portion of said back surface of said substrate.

* * * * *

UNITED STATES PATENT AND TRADEMARK OFFICE

CERTIFICATE OF CORRECTION

PATENT NO. : 5,815,185

DATED : September 29, 1998

INVENTOR(S) : Joe R. Pietrzyk

It is certified that error appears in the above-identified patent and that said Letters Patent is hereby corrected as shown below:

At Column 5, line 34, delete "election" and insert in lieu thereof --ejection--;

At Column 5, line 36, after "a plurality of ink" delete "election" and insert in lieu thereof --ejection--;

At Column 5, line 36, after "each ink" delete "election" and insert in lieu thereof --ejection--;

At Column 5, line 37, delete "election" and insert in lieu thereof --ejection--;

At Column 5, line 38, delete "election" and insert in lieu thereof --ejection--;

At Column 5, line 39, delete "elect" and insert in lieu thereof --eject--;

At Column 5, line 50, delete "election" and insert in lieu thereof --ejection--; and At Column 5, line 55, delete "election" and insert in lieu thereof --ejection--.

Signed and Sealed this

Fifth Day of January, 1999

*Attest:*

*Attesting Officer*

*Acting Commissioner of Patents and Trademarks*